US010456631B2

(12) United States Patent
Ricci et al.

(10) Patent No.: US 10,456,631 B2
(45) Date of Patent: Oct. 29, 2019

(54) GOLF BALL INCORPORATING AT LEAST ONE CAST LAYER OF THERMOSET POLYMER MIXTURE HAVING A CENTERING TIME THAT IS INDEPENDENT OF CURE TIME AND IS LOWER THAN THE CENTERING TIME OF THE THERMOSET POLYMER COMPOSITION PORTION OF THE MIXTURE

(71) Applicant: Acushnet Company, Fairhaven, MA (US)

(72) Inventors: Shawn Ricci, New Bedford, MA (US); Brian Comeau, Berkley, MA (US); Mark L. Binette, Mattapoisett, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/356,123

(22) Filed: Mar. 18, 2019

(65) Prior Publication Data

US 2019/0209897 A1 Jul. 11, 2019

Related U.S. Application Data

(62) Division of application No. 15/618,456, filed on Jun. 9, 2017, now Pat. No. 10,328,311.

(51) Int. Cl.
*A63B 37/06* (2006.01)
*A63B 37/00* (2006.01)

(52) U.S. Cl.
CPC ..... *A63B 37/0074* (2013.01)

(58) Field of Classification Search
CPC ..... A63B 37/007
USPC ..... 473/351
See application file for complete search history.

(56) References Cited

U.S. PATENT DOCUMENTS

| | | | |
|---|---|---|---|
| 4,985,477 | A | 1/1991 | Collins et al. |
| 5,204,088 | A | 4/1993 | Noebel et al. |
| 5,500,216 | A | 3/1996 | Julian et al. |
| 6,042,768 | A | 3/2000 | Calabria et al. |
| 6,228,133 | B1 | 5/2001 | Thurber et al. |
| 6,303,731 | B1 | 10/2001 | Carlson et al. |
| 6,322,650 | B1 | 11/2001 | Gilmore et al. |
| 6,355,317 | B1 | 3/2002 | Reid et al. |
| 6,387,316 | B1 | 5/2002 | Marshall |
| 6,884,904 | B2 | 4/2005 | Smith et al. |
| 7,067,081 | B2 | 6/2006 | Simonutti et al. |
| 7,207,904 | B2 | 4/2007 | Isogawa et al. |
| 7,208,538 | B2 | 4/2007 | Taylor et al. |
| 8,003,176 | B2 | 8/2011 | Ylitalo et al. |
| 8,021,590 | B2 | 9/2011 | Kuttappa |
| 8,202,462 | B2 | 6/2012 | Kuttappa |
| 8,487,029 | B2 | 7/2013 | Wang |
| 8,772,398 | B2 | 7/2014 | Strange et al. |
| 9,279,073 | B2 | 3/2016 | Bleecher |
| 9,388,325 | B2 | 7/2016 | Jones et al. |
| 2005/0277717 | A1 | 12/2005 | Joshi et al. |
| 2008/0203615 | A1 | 8/2008 | Brum |
| 2009/0025870 | A1 | 1/2009 | Tanaka |
| 2009/0166924 | A1 | 7/2009 | Kuttappa |
| 2009/0198036 | A1 | 8/2009 | Duffy |
| 2010/0266855 | A1 | 10/2010 | Zubowski |
| 2012/0064999 | A1 | 3/2012 | Ricci |
| 2016/0346972 | A1 | 12/2016 | Binette |

OTHER PUBLICATIONS

The effect of filler size, rheology control agent content and temperature variation on viscosity of epoxy resin system; F. Nihal Tuzun; pp. 52-57.

*Primary Examiner* — Raeann Gorden
(74) *Attorney, Agent, or Firm* — Margaret C. Barker

(57) ABSTRACT

Golf ball comprising cast layer of thermoset polymer mixture having centering time $Ct_1$ and comprising: (i) a polyurethane composition, polyurea composition, and/or polyurethane/polyurea hybrid composition; and (ii) a treated fumed silica compound in an amount such that centering time $Ct_1$ is independent of the thermoset polymer mixture's degree of cure and lower than a centering time $Ct_2$ of the thermoset polymer composition (which is dependent on its gel window $G_w$). The treated fumed silica compound may be surface treated with at least one of polydimethylsiloxane, hexamethyldisilazane, and dimethyldichlorosilane. In some embodiments, delta time $\Delta t_1$ between a dispensing time $D_{t1}$ of the thermoset polymer mixture and centering time $Ct_1$ is less than a delta time $\Delta t_2$ between $Ct_1$ and centering time $Ct_2$. Centering time $Ct_1$ and dispensing time $D_{t1}$ may differ by less than 10 seconds or even by 5 seconds or less.

16 Claims, No Drawings

GOLF BALL INCORPORATING AT LEAST ONE CAST LAYER OF THERMOSET POLYMER MIXTURE HAVING A CENTERING TIME THAT IS INDEPENDENT OF CURE TIME AND IS LOWER THAN THE CENTERING TIME OF THE THERMOSET POLYMER COMPOSITION PORTION OF THE MIXTURE

CROSS-REFERENCE TO RELATED APPLICATIONS

This application is a divisional of co-assigned, co-pending U.S. patent application Ser. No. 15/618,456, filed on Jun. 9, 2017.

FIELD OF THE INVENTION

Golf ball constructions incorporating cast layer(s) of polyurethane, polyurea, and/or polyurethane/polyurea hybrid compositions.

BACKGROUND OF THE INVENTION

Conventional golf balls can be divided into two general classes: solid and wound. Solid golf balls include one-piece, two-piece (i.e., single layer core and single layer cover), and multi-layer (i.e., solid core of one or more layers and/or a cover of one or more layers) golf balls. Wound golf balls typically include a solid, hollow, or fluid-filled center, surrounded by a tensioned elastomeric material, and a cover.

Examples of golf ball materials range from rubber materials, such as balata, styrene butadiene, polybutadiene, or polyisoprene, to thermoplastic or thermoset resins such as ionomers, polyolefins, polyamides, polyesters, polyurethanes, polyureas and/or polyurethane/polyurea hybrids, and blends thereof. Typically, outer layers are formed about the spherical outer surface of an innermost golf ball layer via compression molding, casting, or injection molding.

From the perspective of a golf ball manufacturer, it is desirable to have materials exhibiting a wide range of properties, such as resilience, durability, spin, and "feel," because this enables the manufacturer to make and sell golf balls suited to differing levels of ability and/or preferences. In this regard, playing characteristics of golf balls, such as spin, feel, CoR and compression can be tailored by varying the properties of the golf ball materials and/or adding additional golf ball layers such as at least one intermediate layer disposed between the cover and the core. Intermediate layers can be of solid construction, and have also been formed of a tensioned elastomeric winding. The difference in play characteristics resulting from these different types of constructions can be quite significant.

Conventionally, golf balls are made by molding outer layers about a core. Outer layers such as the cover may be injection molded, compression molded, or cast over the core.

Injection molding typically requires a mold having at least one pair of mold cavities; e.g., a first mold cavity and a second mold cavity, which mate to form a spherical recess. In addition, a mold may include more than one mold cavity pair. In one injection molding process, each mold cavity includes retractable positioning pins to hold the core in the spherical center of the mold cavity pair. Once the core is positioned in the first mold cavity, the respective second mold cavity is mated to the first to close the mold. A cover material is then injected into the closed mold. The positioning pins are retracted while the cover material is flowable to allow the material to fill in any holes caused by the pins. When the material is at least partially cured, the covered core is removed from the mold (demolded).

Compression molds also typically include multiple pairs of mold cavities, each pair comprising first and second mold cavities that mate to form a spherical recess. In one such compression molding process, a cover material is preformed into half-shells, which are placed, respectively, into each of a pair of compression mold cavities. The core is placed between the cover material half-shells and the mold is closed. The core and cover combination is then exposed to heat and pressure, which cause the cover half-shells to combine and form a full cover.

Casting is a common method of producing a urethane, urea or urethane/urea hybrid outer layer about a core or other subassembly. A desired benefit of casting golf ball layers about subassemblies is that the resulting layer has a substantially uniform thickness.

In a casting process, a castable composition is introduced into a first mold cavity of a given pair of mold half shells. The core/subassembly is then either placed directly into the composition or is held in position (e.g., by an overhanging vacuum or suction apparatus) to contact the material in what will be the spherical center of the mold cavity pair. Once the castable composition is at least partially cured (e.g., to a point where the core will not substantially move), additional castable composition is introduced into a second mold cavity of each pair, and the mold is closed. The closed mold is then subjected to heat and pressure to cure the composition, thereby forming the outer layer about the core. The mold cavities can have smooth surfaces or include a negative dimple pattern to impart dimples in the composition during the molding process where the cast layer is a cover, for example.

It is important that a core/subassembly be centered in the castable composition within a mold cavity before the mold halves are mated because a non-centered core/subassembly can create and result in undesirable playing characteristics. Unfortunately, conventional castable outer layer compositions rely on achieving sufficient "degree of cure" before reaching a suitable state for centering the core/subassembly immovably therein. Specifically, in conventional castable compositions, the centering time isn't reached until a necessary degree of polymerization occurs, which prompts viscosity build. As a result, support devices such as pins are commonly used to support the core/subassembly until sufficient cure occurs to center the core/subassembly.

Several drawbacks are associated with centering time being tied to degree of cure. Some conventional castable formulations may cure too quickly—that is, set up too quickly to mold upon being dispensed from the static mixer. This can leave insufficient time to center the core/subassembly. Other formulations build sufficient viscosity too slowly based on the nature of the particular curing profile. And while heat and/or catalysts can be used to improve or increase reaction speed, such additives or amounts thereof can negatively impact the integrity of the resulting polymer. In still other formulations, the remaining "gel window" for adjusting the core/subassembly in the composition/mold once sufficient cure is indeed achieved is undesirably short.

These drawbacks can be further compounded in conventional castable foam compositions because sufficient cure and viscosity build for centering may not be reached until after the foam composition's rise time—the time from dispensing the foam composition into a mold until the foam composition reaches its maximum height or thickness. This can result in the core/subassembly continuing to move while the foam composition rises, with the finished golf ball having a non-centered a core/subassembly with respect to that foamed layer as well as outer layers formed about the foamed layer.

Golf ball manufacturers have addressed these problems heretofore by providing securing means (such as pins) in the molding equipment in order to hold the core/subassembly in a centered position while the conventional compositions develop sufficient viscosity or degree of cure within the mold to center the core/subassembly immovably. Such pin molds generally contain a series of protruding pins designed to secure the core/subassembly concentrically in place within in the layer composition prior to sufficient cure. A predetermined shot weight is dispensed into a pin mold, the core/subassembly is immediately plunged, and the two mold halves are mated. The pins are designed to hold the core/assembly in the correct position while the composition cures to completion, thereby producing a concentrically placed golf ball core/subassembly surrounded by an outer layer.

One significant problem with using securing means such as pins is that the resulting golf ball layer in the final golf ball product can have material missing at pin holes that are created by the pins. Such pin holes provide and serve as initiation points for impact durability failure. While U.S. Pat. No. 8,021,590 of Kuttappa offers a potential solution to a different casting centering problem—namely non-alignment at the parting line between two hemispherical shells (being mismatched or offset at the parting line when mated), the above-described centering problem associated with conventional casting compositions remains unsolved.

Accordingly, due to the benefits associated with cast golf ball layers, there is a need for golf balls incorporating improved castable outer layer compositions that can reach a centering time irrespective of cure time and well before rise time (for foams) and can meanwhile be produced cost effectively within existing manufacturing processes and without the need for pins or other securing means and without sacrificing desirable physical properties and playing characteristics. Golf balls incorporating such improved castable compositions would be particularly desirable and useful. The current golf balls of the invention incorporating such castable layers and methods for making same address and solve these needs.

SUMMARY OF THE INVENTION

Accordingly, in one embodiment, a golf ball of the invention comprises a subassembly and at least one cast layer consisting of a thermoset polymer mixture. The thermoset polymer mixture has a centering time $Ct_1$ and consists of (i) a thermoset polymer composition consisting of at least one of a polyurethane composition, a polyurea composition, or a polyurethane/polyurea hybrid composition; and (ii) a treated fumed silica compound in an amount such that centering time $Ct_1$ is independent of the thermoset polymer mixture's degree of cure and lower than a centering time $Ct_2$ of the thermoset polymer composition. Centering time $Ct_2$ is undesirably dependent on a gel window $G_w$ of the thermoset polymer composition.

The treated fumed silica compound may be surface treated with at least one of polydimethylsiloxane, hexamethyldisilazane, and dimethyldichlorosilane.

A delta time $\Delta t_1$ between a dispensing time $D_{t1}$ of the thermoset polymer mixture (the time at which the thermoset polymer mixture is dispensed into the mold) and centering time $Ct_1$, can be less than a delta time $\Delta t_2$ between $Ct_1$ and centering time $Ct_2$.

In one embodiment, centering time $Ct_1$ and dispensing time $D_{t1}$ may differ by less than 10 seconds. In another embodiment, centering time $Ct_1$ and dispensing time $D_{t1}$ may differ by 5 seconds or less.

In a particular embodiment, a prepolymer and the surface treated fumed silica may be included in the thermoset polymer mixture in a ratio of from about 4:1 to about 18:1. Meanwhile, a curative and the surface treated fumed silica may be included in the thermoset polymer mixture in a ratio of from about 0.5:1 to about 6:1.

In a different embodiment, the prepolymer and the surface treated fumed silica may be included in the thermoset polymer mixture in a ratio of from about 10:1 to about 12:1, while the curative and the surface treated fumed silica are included in the thermoset polymer mixture in a ratio of from about 1.5:1 to about 2.5:1.

In one embodiment, the cast layer may have a thickness of 0.020 inches or greater. In another embodiment, the cast layer may have a thickness of greater than 0.020 inches. In yet another embodiment, the cast layer may have a thickness of 0.025 inches or greater.

In a specific embodiment, the thermoset polymer mixture may be a foam composition and centering time $Ct_1$ of the thermoset polymer mixture is less than its rise time $Rt_1$. In some embodiments, a delta time $\Delta t_1$ between a dispensing time $D_{t1}$ of the thermoset polymer mixture and centering time $Ct_1$ may be less than a delta time $\Delta t_3$ between $Ct_1$ and rise time $Rt_1$.

In one such embodiment, deionized water and the surface treated fumed silica may be included in the thermoset polymer mixture in a ratio of from about 3:1 to about 13:1. Thermoset polymer mixtures that are foam compositions may be selected, for example, from the group consisting of polyurethane foams, polyurea foams, polyurethane/polyurea hybrid foams, or combinations thereof.

The invention also relates to a method of making a golf ball of the invention comprising the steps of: providing a subassembly; casting at least one layer of thermoset polymer mixture about the subassembly by: (a) dispensing a thermoset polymer mixture within a smooth or dimpled inner surface of a first hemispherical cavity of a first casting mold half shell; and (b) plunging the subassembly into the thermoset polymer mixture and centering the subassembly there within. In this regard, the thermoset polymer mixture has a centering time $Ct_1$ and consists of: (i) a thermoset polymer composition consisting of at least one of a polyurethane composition, a polyurea composition, or a polyurethane/polyurea hybrid composition; and (ii) a treated fumed silica compound in an amount such that centering time $Ct_1$ is independent of the thermoset polymer mixture's degree of cure and lower than a centering time $Ct_2$ of the thermoset polymer composition.

In some embodiments, the thermoset polymer mixture may be shear thinned for at least part of a duration extending from dispensing time $D_{t1}$ to centering time $Ct_1$.

DETAILED DESCRIPTION

Advantageously, a golf ball of the invention incorporates at least one cast layer of thermoset polymer mixture having a centering time that is independent of its curing profile, thereby overcoming at least the aforementioned drawbacks associated with casting conventional compositions wherein development of sufficient viscosity for centering is tied to degree of cure. Golf balls of the invention can therefore be produced cost effectively and within existing manufacturing processes yet without pins or other supporting means and meanwhile having desirable physical properties and playing characteristics.

One further distinct benefit of a cast layer of inventive thermoset polymer mixture in a golf ball of the invention is that the resulting layer has a uniform thickness and also may be sized and shaped to match/follow the contour of an adjacent inner and/or outer layer, with excellent adhesion at an interface there between, thereby avoiding the durability issues which can arise when gaps form between adjacent layers.

As used herein, the term "centering time" refers to the time at which a core or other subassembly remains centered immovably in a castable composition within a casting mold half shell and without support (such as by using pins, clamps, prongs, etc.).

In particular, the thermoset polymer mixture has a centering time $Ct_1$ and consists of (i) a thermoset polymer composition consisting of at least one of a polyurethane composition, a polyurea composition, or a polyurethane/polyurea hybrid composition; and (ii) a treated fumed silica compound in an amount such that centering time $Ct_1$ is independent of the thermoset polymer mixture's degree of cure, and lower than the centering time $Ct_2$ of the thermoset polymer composition (which is indeed dependent on the degree of cure and is generally marked by the onset of a gel window $G_w$ of the thermoset polymer composition). In this regard, onset of the gel window of the thermoset polymer composition itself may be identified using, for example, a Scanning Vibrating Needle Curemeter (SVNC) from Smithers Rapra.

A delta time $\Delta t_1$ between a dispensing time $D_{t1}$ of the thermoset polymer mixture and centering time $Ct_1$ can be less than a delta time $\Delta t_2$between $Ct_1$ and centering time $Ct_2$. In one embodiment, centering time $Ct_1$ and dispensing time $D_{t1}$ may differ by less than 10 seconds. In another embodiment, centering time $Ct_1$ and dispensing time $D_{t1}$ may differ by 5 seconds or less.

It should be understood that even a time lapse of 20 or more seconds between $D_{t1}$ and $Ct_1$ can be notable, for example, where the thermoset polymer composition itself would be a desirable golf ball castable composition but for the fact that $Ct_2$ develops too slowly due to the thermoset polymer composition's cure profile, whereas the thermoset polymer mixture's $Ct_1$ of 20 or more seconds is a significant improvement over $Ct_2$. And even where a thermoset polymer composition has a gel window $G_w$ onset as early as 15 seconds after dispensing time $D_{t1}$, a thermoset polymer mixture of the invention still provides the desirable and advantageous benefit over the thermoset polymer composition of totally avoiding the aforementioned well known drawbacks, problems and unpredictability associated with centering time being dependent on gel window $G_w$. Thus, the thermoset polymer mixture becomes an efficient and cost effective casting composition option whereas the thermoset polymer composition would not be a practical alternative due its poor centering time being dependent on cure profile.

The phrase "a treated fumed silica compound", as used herein, refers to at least one treated fumed silica compound and includes combinations of treated silica compounds. The treated fumed silica compound may be surface treated such as with at least one of polydimethylsiloxane, hexamethyldisilazane, and dimethyldichlorosilane.

A golf ball of the invention incorporating at least one cast layer of inventive thermoset polymer mixture has a reliably and desirably uniform thickness and contour. Such thickness may be any known castable thickness such as 0.020 inches or greater, or greater than 0.020 inches, or 0.025 inches or greater, and even up to 0.050 inches or greater. Other examples of suitable thicknesses range from about 0.20 inches to about 0.050 inches, or from about 0.025 inches to about 0.050 inches, or from about 0.30 inches to about 0.050 inches, or from about 035 inches to about 0.050 inches, or from about 0.040 inches to about 0.50 inches, even about 0.045 inches.

In a specific embodiment, the thermoset polymer mixture may be a foam composition and centering time $Ct_1$ of the thermoset polymer mixture is less than its rise time $Rt_1$. In some embodiments, a delta time $\Delta t_1$ between a dispensing time $D_{t1}$ of the thermoset polymer mixture and centering time $Ct_1$ may be less than a delta time $\Delta t_3$ between $Ct_1$ and rise time $Rt_1$.

In one embodiment, deionized water and the surface treated fumed silica may be included in the thermoset polymer mixture in a ratio of from about 3:1 to about 13:1. Thermoset polymer mixtures that are foam compositions may be selected, for example, from the group consisting of polyurethane foams, polyurea foams, polyurethane/polyurea hybrid foams, or combinations thereof.

Thermoset polymer mixtures of the invention can be reliably and cost effectively cast about a core (or other golf ball subassembly) due to interactions between the treated fumed silica and ingredients of the polymer composition portion of the thermoset polymer mixture. The thermoset polymer mixture can be formulated to achieve a suitable state for centering the core/subassembly immovably therein either simultaneously with or soon after being dispensed into a casting mold to produce cast layers that are thicker than paint or coating thicknesses (which are sprayed about or otherwise applied onto a golf ball surface.

The thermoset polymer mixtures of the invention incorporate thermoset polymer compositions having a centering time that is dependent on cure (and gel time) and being cross-linked polymers produced from at least the reaction of an isocyanate and a polyol or polyamine cured with a primary diamine or polyfunctional glycol. The various properties of the golf ball and golf ball components, e.g., hardness, may be controlled by adjusting the ratio of prepolymer to curing agent, which is a function of the NCO content of the prepolymer and molecular weight of the curing agent.

The ratio of the prepolymer to curing agent in the thermoset polymer mixture is generally determined by the nitrogen-carbon-oxygen group (NCO) content of the polyurethane prepolymer. In one embodiment, the total NCO content will generally be less than 20%, or be in the range of 2.0% to 18.0%, or 3.0% to 9.0%, or 5.0% to 8.0%, or 4.0% to 9.0%, or 2.0% to 6.0%. However, embodiments are indeed envisioned wherein prepolymer blends are used containing isocyanates having NCO contents of as high as about 31%.

The amount of treated fumed silica compound(s) necessary to produce centering time $Ct_1$ is at least partially related to the functionality and/or NCO content of the particular isocyanate(s) used in the thermoset polymer mixture. Generally, prepolymers based on isocyanates having higher functionality can have higher viscosity. Meanwhile, prepolymers having higher NCO content typically have lower viscosity.

A sufficient amount of treated fumed silica compound(s) can also be combined with additional ingredients such as conventional reaction modifying additives or catalysts which won't make $Ct_1$ independent of cure profile but do provide a different reaction benefit.

Thus, unlike conventional systems wherein viscosity build is undesirably dependent on the composition's cure profile, viscosity build of a thermoset polymer mixture of the invention is independent of cure profile, thereby permitting centering time $C_1$ to be controlled irrespective of degree of cure so that molding can occur flexibly soon after the thermoset polymer mixture of the invention is dispensed from the mix head into the mold.

Examples of suitable ratios in which to combine the surface treated fumed silica compound(s) with other ingredients to produce a castable layer of thermoset polymer mixture include the following. A prepolymer and the surface treated fumed silica may generally be included in the thermoset polymer mixture in a ratio of from about 4:1 to about 18:1. A curative and the surface treated fumed silica may meanwhile be included in the thermoset polymer mixture in a ratio of from about 0.5:1 to about 6:1.

In a specific embodiment, the prepolymer and the surface treated fumed silica may be included in the thermoset polymer mixture in a ratio of from about 10:1 to about 12:1, while the curative and the surface treated fumed silica are included in the thermoset polymer mixture in a ratio of from about 1.5:1 to about 2.5:1.

In one embodiment, the thermoset polymer mixture may be a foam composition wherein centering time $Ct_1$ of the thermoset polymer mixture is less than its rise time $Rt_1$. In such embodiments, deionized water and the surface treated fumed silica may be included in the thermoset polymer mixture in a ratio of from about 3:1 to about 13:1. In such embodiments, the thermoset polymer mixture may be selected, for example, from the group consisting of polyurethane foams, polyurea foams, polyurethane/polyurea hybrid foams, or combinations thereof.

The amount of treated fumed silica compound(s) used will vary depending on the particular types and amounts of prepolymer, polyol and curing agent and can be adjusted according to the functionality/NCO content and presence/absence of additional reaction modifiers as well the amounts thereof included to produce a thermoset polymer mixture having $C_1$. Additives, fillers and reaction or density modifiers may also be included in the thermoset polymer mixture.

Examples of such additives may be selected from the group consisting of silicone surfactant(s), mixed mineral thixotrope compound(s), tertiary amine(s), organometallic catalyst(s) such as those based on zinc and/or tin, or acid catalysts. Examples of acid catalysts include sulfuric acid, hydrochloric acid, methanesulfonic acid, benzenesulfonic acid, toluenesulfonic acid, naphthalenesulfonic acid, methionic acid, phosphoric acid, perchloric acid, and boron trifluoride.

In one non-limiting embodiment, the thermoset polymer mixture includes MDI/PTMEG (4,4'-diphenylmethane diisocyanate/polytetramethylene ether glycol) prepolymer@18% NCO, Ethacure®300 (aromatic diamine curative available from Albemarle Corporation), and CAB-O-SIL® TS-720 (surface treated fumed silica available from CABOT), wherein the ratio of prepolymer to Cab-o-sil® is 13.2:1 and the ratio of curative to Cab-o-sil® is 5.8:1. In another such embodiment, the ratio of prepolymer to Cab-o-sil® is 6.3:1 and the ratio of curative to Cab-o-sil® is 2.7:1.

In yet another embodiment, the thermoset polymer mixture includes MDUPTMEG prepolymer@3% NCO, Ethacure®300, and CAB-O-SIL®TS-720, wherein the ratio of prepolymer to Cab-o-sil® is 17.7:1 and the ratio of curative to Cab-o-sil® is 1.3:1. In another such embodiment, the ratio of prepolymer to Cab-o-sil® is 8.4:1 and the ratio of curative to Cab-o-sil® is 0.6:1.

In still another embodiment, the thermoset polymer mixture includes MDUPTMEG prepolymer@6.5% NCO, Mondur®MR (an aromatic polymeric isocyanate based on diphenylmethane-diisocyanate (MDI)), Capa®4101 (a tetra-functional polyol terminated with primary hydroxyl groups), and CAB-O-SIL®TS-720, wherein the ratio of prepolymer to Cab-o-sil is 4.6:1 and the ratio of curative to Cab-o-sil® is 0.8:1.

In a one embodiment, the thermoset polymer mixture may be a foam composition, wherein centering time $Ct_1$ of the thermoset polymer mixture is less than its rise time $Rt_1$. In such embodiments, the thermoset polymer mixture may be selected, for example, from the group consisting of polyurethane foams, polyurea foams, polyurethane/polyurea hybrid foams, or combinations thereof.

For example, the thermoset polymer mixture may include MDUPTMEG prepolymer@6.5% NCO, Mondur®MR, Capa®4101, CAB-O-SIL®TS-720, and deionized water ("DI water"), wherein the ratio of prepolymer to Cab-o-sil® is 11.2:1, the ratio of curative to Cab-o-sil® is 2:1, and the ratio of Cab-o-sil® to DI water is 5.2:1. In this embodiment, the thermoset polymer mixture also includes Niax® 1500 (a silicone surfactant available from Momentive Performance Materials, Inc.), Garamite®1958 (a mixed mineral thixotrope available from BYK Additives & Instruments), and Dabco®33LV (a tertiary amine catalyst available from Air Products and Chemicals, Inc.). In this embodiment, the DI water is included with each of these ingredients in respective ratios of 2.4:1; 4.7:1; and 9.1:1.

In an alternative such embodiment, the ratio of Cab-o-sil® to DI water is 12.2:1; the DI water and Niax® are included in a ratio of 2:1; the DI and Garamite® are included in a ratio of 1:1; and the DI water and Dabco® are included in a ratio of 3.8:1.

In another embodiment, the thermoset polymer mixture includes MDI/PTMEG prepolymer@6.5% NCO, Mondur®MR, Capa®4101, CAB-O-SIL®TS-720, and deionized water ("DI water"), wherein the ratio of prepolymer to Cab-o-sil® is 11.2:1, the ratio of curative to Cab-o-sil® is 2:1, and the ratio of Cab-o-sil® to DI water is 3.1:1. In this embodiment, Niax®1500 and Dabco®33LV are also included in the thermoset polymer mixture. In this embodiment, the DI water and Niax®1500 are included in a ratio of 2.4:1; while the DI water and Dabco®33LV are included in a ratio of 4.7:1; and 9.1:1.

The invention also relates to a method of making a golf ball of the invention comprising the steps of: providing a subassembly; casting at least one layer of thermoset polymer mixture about the subassembly by: (a) dispensing a thermoset polymer mixture within a smooth or dimpled inner surface of a first hemispherical cavity of a first casting mold half shell; and (b) plunging the subassembly into the thermoset polymer mixture and centering the subassembly there within. In this regard, the thermoset polymer mixture has a centering time $Ct_1$ and consists of: (i) a thermoset polymer composition consisting of at least one of a polyurethane composition, a polyurea composition, or a polyurethane/polyurea hybrid composition; and (ii) a treated fumed silica compound in an amount such that centering time $Ct_1$ is independent of the thermoset polymer mixture's degree of cure and lower than a centering time $Ct_2$ of the thermoset polymer composition.

In some embodiments, the thermoset polymer mixture may be shear thinned for a duration prior to dispensing time $D_{t1}$.

In some embodiments, the MDI/PTMEG prepolymer, Mondur® MR Isocyanate and a first portion of the CAB-O-SIL®TS-720 may be combined ("part A") in a first mixer. Meanwhile, the Capa®4101 polyol, DI water, Niax® 1500 surfactant, Garamite® 1958 and Dabco 33LV catalyst may be combined with a second portion of the CAB-O-SIL®TS-720 ("part B") in a second mixer.

A series of trials were performed using various ratios of CAB-O-SIL®TS-720 to other ingredients discussed herein. In each trial, a thermoset polymer mixture was dispensed into otherwise conventional urethane casting equipment that was modified to implement 1.620" first and second smooth casing mold half shells in lieu of pin mold half shells.

The ratios disclosed herein produced a resulting thermoset polymer mixture that had a visibly suitable viscosity for plunging and centering a respective rubber core immediately following being dispensed into each mold half such $Ct_1$ could be achieved within less than 5 seconds, or less than 10 seconds, etc. as desired and targeted by modifying the formulation, at which targeted time the mold halves could be and were mated together. The resulting cast layer of thermoset polymer mixture had a uniform thickness of 0.045 inches and was conformally and adhesively mated with and about an outer surface of a rubber core.

The thermoset polymer composition itself may be made using at least the ingredients disclosed herein for forming polyurethanes, polyureas, polyurethane/polyurea hybrids, polyurethane foams, polyurea foams, polyurethane/polyurea hybrid foams, or combinations thereof. Thus, for example, the polyurethane polymer compositions incorporated in the inventive thermoset polymer mixture may be formed from the reaction product of at least one polyisocyanate and at least one curing agent.

The curing agent can include, for example, one or more diamines, one or more polyols, or a combination thereof. The at least one polyisocyanate can be combined with one or more polyols to form a prepolymer, which is then combined with the at least one curing agent. Thus, when polyols are described herein they may be suitable for use in one or both components of the polyurethane material, that is, as part of a prepolymer and in the curing agent. The curing agent includes a polyol curing agent preferably selected from the group consisting of ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy)ethoxy]ethoxy}benzene; 1,4-butanediol; 1,5-pentanediol; 1,6-hexanediol; resorcinol-di-(.beta.-hydroxyethyl)ether; hydroquinone-di-(.beta.-hydroxyethyl) ether; trimethylol propane; and combinations thereof.

Suitable polyurethane polymer compositions also include those formed from the reaction product of at least one isocyanate and at least one curing agent or the reaction product of at least one isocyanate, at least one polyol, and at least one curing agent. Preferred isocyanates include those selected from the group consisting of 4,4'-diphenylmethane diisocyanate, polymeric 4,4'-diphenylmethane diisocyanate, carbodiimide-modified liquid 4,4'-diphenylmethane diisocyanate, 4,4'-dicyclohexylmethane diisocyanate, p-phenylene diisocyanate, toluene diisocyanate, isophoronediisocyanate, p-methylxylene diisocyanate, m-methylxylene diisocyanate, o-methylxylene diisocyanate, and combinations thereof. Preferred polyols include those selected from the group consisting of polyether polyol, hydroxy-terminated polybutadiene, polyester polyol, polycaprolactone polyol, polycarbonate polyol, and combinations thereof. Preferred curing agents include polyamine curing agents, polyol curing agents, and combinations thereof. Polyamine curing agents are particularly preferred. Preferred polyamine curing agents include, for example, 3,5-dimethylthio-2,4-toluenediamine, or an isomer thereof; 3,5-diethyltoluene-2,4-diamine, or an isomer thereof; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); trimethylene glycol-di-p-aminobenzoate; polytetramethyleneoxide-di-p-aminobenzoate; N,N'-dialkyldiamino diphenyl methane; p,p'-methylene dianiline; phenylenediamine; 4,4'-methylene-bis-(2-chloroaniline); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); and combinations thereof.

The composition is not limited by the use of a particular polyisocyanate. Suitable polyisocyanates include, but are not limited to, 4,4'-diphenylmethane diisocyanate ("MDI"), polymeric MDI, carbodiimide-modified liquid MDI, 4,4'-dicyclohexylmethane diisocyanate ("H.sub.12MDI"), p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diisocyanate; and combinations thereof. Polyisocyanates are known to those of ordinary skill in the art as having more than one isocyanate group, e.g., di-, tri-, and tetra-isocyanate. Preferably, the polyisocyanate is selected from MDI, PPDI, TDI, and combinations thereof. More preferably, the polyisocyanate includes MDI. It should be understood that, as used herein, the term "MDI" includes 4,4'-diphenylmethane diisocyanate, polymeric MDI, carbodiimide-modified liquid MDI, combinations thereof and, additionally, that the diisocyanate employed may be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, low free monomer TDI, and low free monomer PPDI.

The at least one polyisocyanate may for example have about 18% or less unreacted NCO groups. In some embodiments, the at least one polyisocyanate has no greater than 8.5% NCO, more preferably from 2.5% to 8.0%, or from 3.0% to 7.2%, or from 5.0% to 6.5%.

The composition is further not limited by the use of a particular polyol. In one embodiment, the molecular weight of the polyol is from about 200 to about 6000. Exemplary polyols include, but are not limited to, polyether polyols, hydroxy-terminated polybutadiene (including partially/fully hydrogenated derivatives), polyester polyols, polycaprolactone polyols, and polycarbonate polyols. Particularly preferred are polytetramethylene ether glycol ("PTMEG"), polyethylene propylene glycol, polyoxypropylene glycol, and combinations thereof. The hydrocarbon chain can have saturated or unsaturated bonds and substituted or unsubstituted aromatic and cyclic groups. Preferably, the polyol includes PTMEG. Suitable polyester polyols include, but are not limited to, polyethylene adipate glycol, polybutylene adipate glycol, polyethylene propylene adipate glycol, ortho-phthalate-1,6-hexanediol, and combinations thereof. The hydrocarbon chain can have saturated or unsaturated bonds, or substituted or unsubstituted aromatic and cyclic groups. Suitable polycaprolactone polyols include, but are not limited to 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and combinations thereof. The hydrocarbon chain can have saturated or unsaturated bonds, or substituted or unsubstituted aromatic and cyclic groups. Suitable polycarbonates include, but are not limited to, polyphthalate carbonate. The hydrocarbon chain can have saturated or unsaturated bonds, or substituted or unsubstituted aromatic and cyclic groups.

Polyamine curatives are also suitable for use in the curing agent of polyurethane compositions and have been found to improve cut, shear, and impact resistance of the resultant balls. Preferred polyamine curatives include, but are not limited to 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene, 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'- diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; and combinations thereof. Preferably, the curing agent includes 3,5-dimethylthio-2,4-toluenediamine and isomers thereof, such as ETHACURE®300. Suitable polyamine curatives, which include both primary and secondary amines, preferably have weight average molecular weights ranging from about 64 to about 2000.

At least one of a diol, triol, tetraol, or hydroxy-terminated curative may be added to the polyurethane composition. Suitable diol, triol, and tetraol groups include ethylene glycol; diethylene glycol; polyethylene glycol; propylene glycol; polypropylene glycol; lower molecular weight polytetramethylene ether glycol; 1,3-bis(2-hydroxyethoxy)benzene; 1,3-bis-[2-(2-hydroxyethoxy)ethoxy]benzene; 1,3-bis-{2-[2-(2-hydroxyethoxy) ethoxy]ethoxy}benzene; 1,4-butanediol; 1,5-pentanediol; 1,6-hexanediol; resorcinol-di-(4-hydroxyethyl)ether; hydroquinone-di-(4-hydroxyethyl) ether; and combinations thereof. Preferred hydroxy-terminated curatives include ethylene glycol; diethylene glycol; 1,4-butanediol; 1,5-pentanediol; 1,6-hexanediol, trimethylol propane, and combinations thereof. Preferably, the hydroxy-terminated curative has a molecular weights ranging from about 48 to 2000. It should be understood that molecular weight, as used herein, is the absolute weight average molecular weight and would be understood as such by one of ordinary skill in the art.

Both the hydroxy-terminated and amine curatives can include one or more saturated, unsaturated, aromatic, and cyclic groups. Additionally, the hydroxy-terminated and amine curatives can include one or more halogen groups. The polyurethane composition can be formed with a blend or mixture of curing agents. If desired, however, the polyurethane composition may be formed with a single curing agent.

Any method known to one of ordinary skill in the art may be used to combine the polyisocyanate, polyol, and curing agent. One commonly employed method, known in the art as a one-shot method, involves concurrent mixing of the polyisocyanate, polyol, and curing agent. This method results in a mixture that is inhomogeneous (more random) and affords the manufacturer less control over the molecular structure of the resultant composition. A preferred method of mixing is known as a pre-polymer method. In this method, the polyisocyanate and the polyol are mixed separately prior to addition of the curing agent. This method affords a more homogeneous mixture resulting in a more consistent polymer composition.

In the casting process, the polyurea and polyurea/urethane compositions can be formed by chain-extending the polyurea prepolymer with a single curing agent or blend of curing agents. The resulting thermoset polymer mixture of the present invention is castable. While thermoplastic polyurea compositions are typically formed by reacting the isocyanate blend and polyamines at a 1:1 stoichiometric ratio, thermoset compositions, on the other hand, are cross-linked polymers and are typically produced from the reaction of the isocyanate blend and polyamines at normally a 1.05:1 stoichiometric ratio.

Suitable polyurethane polymer compositions are further disclosed, for example, in U.S. Pat. Nos. 5,334,673, 6,506,851, 6,756,436, 6,867,279, 6,960,630, and 7,105,623, the entire disclosures of which are hereby incorporated herein by reference. Suitable polyurea polymer compositions are further disclosed, for example, in U.S. Pat. Nos. 5,484,870 and 6,835,794, and U.S. Patent Application No. 60/401,047, the entire disclosures of which are hereby incorporated herein by reference. Suitable polyurethane-urea materials include polyurethane/polyurea blends and copolymers comprising urethane and urea segments, as disclosed in U.S. Patent Application Publication No. 2007/0117923, the entire disclosure of which is hereby incorporated herein by reference.

Numerous possible constructions are envisioned for a golf ball of the invention incorporating at least one cast layer of inventive thermoset polymer mixture. Golf balls of the invention can be of any size, although the USGA requires that golf balls used in competition have a diameter of at least 1.68 inches. For play outside of United States Golf Association (USGA) rules, the golf balls can be of a smaller size. Normally, golf balls are manufactured in accordance with USGA requirements and have a diameter in the range of about 1.68 to about 1.80 inches. Also, the USGA has established a maximum weight of 45.93 g (1.62 ounces) for golf balls. For play outside of USGA rules, the golf balls can be heavier. Thus, the diameter of the golf balls may be, for example, from about 1.680 inches to about 1.800 inches, or from about 1.680 inches to about 1.760 inches, or from about 1.680 inches (43 mm) to about 1.740 inches (44 mm), or even anywhere in the range of from 1.700 to about 1.950 inches.

The diameter and thickness of layers of golf balls of the invention, along with properties such as hardness and compression, may vary depending upon the desired playing performance properties of the golf ball such as spin, initial velocity, and feel. The term, "layer", as used herein, means generally any spherical portion of the golf ball and even includes a very thin moisture barrier film layer, although a very thin moisture barrier film layer should not negatively impact or otherwise alter golf ball playing characteristics.

Advantageously, the inventive cast layer of inventive thermoset polymer mixture may be formed in a wide range of physical properties and playing characteristics and hardness, compression, resilience or CoR, modulus, tensile strength, etc. can be modified to target for example spin, distance, etc. Accordingly, the dimensions of each golf ball component such as the diameter of the core and respective thicknesses of the intermediate layer(s), cover layer(s) and/or coating layer(s) may also be selected and coordinated as known in the art for targeting and achieving such desired playing characteristics or feel.

A golf ball of the invention may for example be a two-piece golf ball, wherein a cast layer of inventive thermoset polymer mixture is formed about a core. Embodiments are indeed also envisioned wherein a golf ball of the invention may have three layers, wherein one or more of the layers is a cast layer of inventive thermoset polymer mixture.

Of course, four layer golf balls are also envisioned, wherein at least one of the layers is a cast layer of thermoset polymer mixture.

Thus, the inventive cast layer of inventive mixture may be any or all of an outer core layer, intermediate core layer, an intermediate layer, an inner cover layer, and/or outer cover layer. That is, golf balls of the invention may incorporate one or more cast layers of inventive mixture in a golf ball having any desired number of layers so long as at least one of the layers is formed about a subassembly which at the very least comprises a spherical innermost layer or center.

And advantageously, a cast layer of inventive thermoset polymer mixture has desirable surface properties which create excellent adhesion at an interface between the cast layer and adjacent layers through interactions between same. The cast layer may be sized and contoured via the mold and mold cavity therein to conformally mate with any adjacent layer during molding. A golf ball of the invention incorporating a cast layer of inventive mixture is therefore durable to withstand the great force of a club striking the golf ball without cracking or otherwise breaking due at least in part to the benefits of a cast layer discussed above.

Golf ball cast layers formed of the inventive thermoset polymer mixture of the invention may have a wide range of hardnesses, for example, a hardness of from about 20 Shore D to about 75 Shore D. In one embodiment, a cast layer formed of the inventive thermoset polymer mixture of the invention may have a hardness of from about 30 Shore D to about 65 Shore D. In another embodiment, a cast layer formed of the inventive thermoset polymer mixture of the invention may have a hardness of from about 40 Shore D to about 60 Shore D. In yet another embodiment, a cast layer formed of the inventive thermoset polymer mixture of the invention may have a hardness of from about 50 Shore D to about 75 Shore D. Embodiments are also indeed envisioned wherein a cast layer formed of the inventive thermoset polymer mixture of the invention may have a hardness of up to 80 Shore D. In some embodiments, the Shore D hardness of a cast layer formed of the inventive thermoset polymer mixture of the invention may be greater than about 50. In other embodiments, a cast layer formed of the inventive thermoset polymer mixture of the invention may have a Shore D hardness of about 50 or less.

Golf ball cast layers formed of the inventive thermoset polymer mixture of the invention may alternatively have a hardness of from about 45 Shore C to about 95 Shore C. In one embodiment, a cast layer formed of the inventive thermoset polymer mixture of the invention may have a hardness of from about 50 Shore C to about 85 Shore C. In another embodiment, a cast layer formed of the inventive thermoset polymer mixture of the invention may have a hardness of from about 60 Shore C to about 90 Shore C. In yet another embodiment, a cast layer formed of the inventive thermoset polymer mixture of the invention may have a hardness of from about 65 Shore C to about 85 Shore C. Embodiments are also indeed envisioned wherein a cast layer formed of the inventive thermoset polymer mixture of the invention may have a hardness of up to 85 Shore C. In some embodiments, the Shore C hardness of a cast layer formed of the inventive thermoset polymer mixture of the invention may be greater than about 70. In other embodiments, a cast layer formed of the inventive thermoset polymer mixture of the invention may have a Shore C hardness of about 70 or less.

Meanwhile, the hardness and density of the resultant cast layer may be targeted by varying the isocyanate, polyol, additives, or a combination thereof. The isocyanate component of the prepolymer along with the chain extender (curing agent) are collectively designated the "hard segment" and the remaining polyol component of the prepolymer is designated the "soft segment." Thus, the hardness of polyurethanes and polyureas can be controlled by changing the ratio of "hard segment" to "soft segment." As the ratio of hard segment to soft segment increases, the hardness of the resulting polyurethane increases accordingly. Conversely, as the ratio of hard segment to soft segment decreases, the hardness of the resulting polyurethane decreases. Changing the ratio of hard segment to soft segment can be achieved by increasing or decreasing the amount of diisocyanate and/or chain extender while keeping the amount of soft segment constant. Typically, this is done by increasing/decreasing the percent of isocyanate in the prepolymer.

A similar effect on hardness may be achieved by varying the molecular weight of the soft segment. For example, using a soft segment having a lower molecular weight will generally result in a polyurethane having a higher hardness compared to a polyurethane in which a higher molecular weight soft segment was used.

Another method of changing the hardness of a polyurethane or polyurea material is by changing the crosslink density of the material. Hardness of the resultant material may be increased by increasing the crosslink density and decreased by decreasing the crosslink density. Additionally, making use of di-, tri-, and tetra-functional materials may also enable one to increase or decrease hardness as desired. Soft segment functionality has some effect on resulting hardness, however, a greater effect is obtained by changing the functionality of either the isocyanate or chain extender. Crosslink density may also be increased through the use of a dual cure system, where an unsaturated polyurethane or polyurea is reacted, followed by a free radical reaction (i.e., peroxide or UV), to create crosslinks at sites of unsaturation.

Thus, materials can be designed to have different hardness values. For example, the cast layer may consist of an MDI/PTMEG prepolymer at an NCO level of 8% which is chain extended with dimethylthiotoluenediamine to produce a polyurethane having a hardness of 64 Shore D. Similarly, the outer cover layer may also be based on an MDI/PTMEG prepolymer at an NCO level of 6% which is chain extended with dimethylthiotoluenediamine resulting in a cover layer that has a hardness of 45 Shore D, significantly softer than the intermediate layer. Alternatively, 6.5% NCO could result in a hardness of 48 Shore D, 9.0% NCO being 65.5 Shore D; and 10.0% NCO being 66.5 Shore D.

The amount of treated fumed silica compound needed to achieve centering time $Ct_1$ should be adjusted and coordinated with such choices.

Meanwhile, cores in a golf ball of the invention may for example be solid, semi-solid, fluid-filled, or hollow, and may have a single-piece or multi-piece structure. The overall diameter of the core and all intermediate layers is often about 80 percent to about 98 percent of the overall diameter of the finished ball. A variety of materials may be used to make the core including thermoset compositions such as rubber, styrene butadiene, polybutadiene, isoprene, polyisoprene, trans-isoprene; thermoplastics such as ionomer resins, polyamides or polyesters; and thermoplastic and thermoset polyurethane and polyurea elastomers.

In one embodiment, the core is a single-piece made from a natural or synthetic rubber composition such as polybutadiene. In other instances, a two-piece core is constructed; that is, there may be two core layers. For example, an inner core portion may be made of a first base rubber material and an outer core layer, which surrounds the inner core, may be made of a second base rubber material. The respective core pieces may be made of the same or different rubber materials. Cross-linking agents and fillers may be added to the rubber materials.

More particularly, materials for solid cores typically include compositions having a base rubber, a filler, an initiator agent, and a cross-linking agent. The base rubber typically includes natural or synthetic rubber, such as polybutadiene rubber. In one embodiment, the base rubber is 1,4-polybutadiene having a cis-structure of at least 40%. The polybutadiene can be blended with other elastomers such as natural rubber, polyisoprene rubber, styrene-butadiene rubber and/or other polybutadienes. Another suitable rubber that may be used in the core is trans-polybutadiene. This polybutadiene isomer is formed by converting the cis-isomer of the polybutadiene to the trans-isomer during a molding cycle. A soft and fast agent such as pentachlorothiophenol (PCTP) or ZnPCTP can be blended with the polybutadiene. These compounds may also function as cis-to-trans catalyst to convert some cis-1,4 bonds in the polybutadiene into trans 1,4 bonds.

Fillers, which may be used to modify such properties as the specific gravity (density-modifying materials), hardness, weight, modulus, resiliency, compression, and the like may be added to the core composition. Normally, the fillers are inorganic, and suitable fillers include numerous metals or metal oxides, such as zinc oxide and tin oxide, as well as barium sulfate, zinc sulfate, calcium carbonate, barium carbonate, clay, tungsten, tungsten carbide, silica, and mixtures thereof. Fillers may also include various foaming agents or blowing agents, zinc carbonate, regrind (recycled core material typically ground to about 30 mesh or less particle size), high-Mooney-viscosity rubber regrind, and the like. In addition, polymeric, ceramic, metal, and glass microspheres may be used.

The core may for example have a diameter ranging from about 0.09 inches to about 1.65 inches. In one embodiment, the diameter of the core of the present invention is about 1.2 inches to about 1.630 inches. For example, when part of a two-piece ball according to invention, the core may have a diameter ranging from about 1.5 inches to about 1.62 inches. In another embodiment, the diameter of the core is about 1.3 inches to about 1.6 inches, preferably from about 1.39 inches to about 1.6 inches, and more preferably from about 1.5 inches to about 1.6 inches. In yet another embodiment, the core has a diameter of about 1.55 inches to about 1.65 inches, preferably about 1.55 inches to about 1.60 inches.

In some embodiments, the core may have an overall diameter within a range having a lower limit of 0.500 or 0.700 or 0.750 or 0.800 or 0.850 or 0.900 or 0.950 or 1.000 or 1.100 or 1.150 or 1.200 or 1.250 or 1.300 or 1.350 or 1.400 or 1.450 or 1.500 or 1.600 or 1.610 inches and an upper limit of 1.620 or 1.630 or 1.640 inches. In a particular embodiment, the core is a multi-layer core having an overall diameter within a range having a lower limit of 0.500 or 0.700 or 0.750 or 0.800 or 0.850 or 0.900 or 0.950 or 1.000 or 1.100 or 1.150 or 1.200 inches and an upper limit of 1.250 or 1.300 or 1.350 or 1.400 or 1.450 or 1.500 or 1.600 or 1.610 or 1.620 or 1.630 or 1.640 inches. In another particular embodiment, the multi-layer core has an overall diameter within a range having a lower limit of 0.500 or 0.700 or 0.750 inches and an upper limit of 0.800 or 0.850 or 0.900 or 0.950 or 1.000 or 1.100 or 1.150 or 1.200 or 1.250 or 1.300 or 1.350 or 1.400 or 1.450 or 1.500 or 1.600 or 1.610 or 1.620 or 1.630 or 1.640 inches. In another particular embodiment, the multi-layer core has an overall diameter of 1.500 inches or 1.510 inches or 1.530 inches or 1.550 inches or 1.570 inches or 1.580 inches or 1.590 inches or 1.600 inches or 1.610 inches or 1.620 inches.

In some embodiments, the inner core can have an overall diameter of 0.500 inches or greater, or 0.700 inches or greater, or 1.00 inches or greater, or 1.250 inches or greater, or 1.350 inches or greater, or 1.390 inches or greater, or 1.450 inches or greater, or an overall diameter within a range having a lower limit of 0.250 or 0.500 or 0.750 or 1.000 or 1.250 or 1.350 or 1.390 or 1.400 or 1.440 inches and an upper limit of 1.460 or 1.490 or 1.500 or 1.550 or 1.580 or 1.600 inches, or an overall diameter within a range having a lower limit of 0.250 or 0.300 or 0.350 or 0.400 or 0.500 or 0.550 or 0.600 or 0.650 or 0.700 inches and an upper limit of 0.750 or 0.800 or 0.900 or 0.950 or 1.000 or 1.100 or 1.150 or 1.200 or 1.250 or 1.300 or 1.350 or 1.400 inches. In one embodiment, the inner core consists of a single layer formed from a thermoset rubber composition. In another embodiment, the inner core consists of two layers, each of which is formed from the same or different thermoset rubber compositions. In another embodiment, the inner core comprises three or more layers, each of which is formed from the same or different thermoset rubber compositions. In another embodiment, the inner core consists of a single layer formed from a thermoplastic composition. In another embodiment, the inner core consists of two layers, each of which is formed from the same or different thermoplastic compositions. In another embodiment, the inner core comprises three or more layers, each of which is formed from the same or different thermoplastic compositions. In some embodiments, the outer core layer can have an overall thickness within a range having a lower limit of 0.010 or 0.020 or 0.025 or 0.030 or 0.035 inches and an upper limit of 0.040 or 0.070 or 0.075 or 0.080 or 0.100 or 0.150 inches, or an overall thickness within a range having a lower limit of 0.025 or 0.050 or 0.100 or 0.150 or 0.160 or 0.170 or 0.200 inches and an upper limit of 0.225 or 0.250 or 0.275 or 0.300 or 0.325 or 0.350 or 0.400 or 0.450 or greater than 0.450 inches. The outer core layer may alternatively have a thickness of greater than 0.10 inches, or 0.20 inches or greater, or greater than 0.20 inches, or 0.30 inches or greater, or greater than 0.30 inches, or 0.35 inches or greater, or greater than 0.35 inches, or 0.40 inches or greater, or greater than 0.40 inches, or 0.45 inches or greater, or greater than 0.45 inches, or a thickness within a range having a lower limit of 0.005 or 0.010 or 0.015 or 0.020 or 0.025 or 0.030 or 0.035 or 0.040 or 0.045 or 0.050 or 0.055 or 0.060 or 0.065 or 0.070 or 0.075 or 0.080 or 0.090 or 0.100 or 0.200 or 0.250 inches and an upper limit of 0.300 or 0.350 or 0.400 or 0.450 or 0.500 or 0.750 inches.

In one embodiment, the outer core consists of a single layer formed from a thermoset rubber composition. In another embodiment, the outer core consists of two layers, each of which is formed from the same or different thermoset rubber compositions. In another embodiment, the outer core comprises three or more layers, each of which is formed from the same or different thermoset rubber compositions. In another embodiment, the outer core consists of a single layer formed from a thermoplastic composition. In another embodiment, the outer core consists of two layers, each of which is formed from the same or different thermoplastic compositions. In another embodiment, the outer core comprises three or more layers, each of which is formed from the same or different thermoplastic compositions.

An intermediate core layer can have an overall thickness within a range having a lower limit of 0.005 or 0.010 or 0.015 or 0.020 or 0.025 or 0.030 or 0.035 or 0.040 or 0.045 inches and an upper limit of 0.050 or 0.055 or 0.060 or 0.065 or 0.070 or 0.075 or 0.080 or 0.090 or 0.100 inches. In one embodiment, the intermediate core consists of a single layer formed from a thermoset rubber composition. In another embodiment, the intermediate core consists of two layers, each of which is formed from the same or different thermoset rubber compositions. In another embodiment, the intermediate core comprises three or more layers, each of which is formed from the same or different thermoset rubber compositions. In another embodiment, the intermediate core consists of a single layer formed from a thermoplastic composition. In another embodiment, the intermediate core consists of two layers, each of which is formed from the same or different thermoplastic compositions. In another embodiment, the intermediate core comprises three or more layers, each of which is formed from the same or different thermoplastic compositions.

The cores and core layers of golf balls of the invention may have varying hardnesses depending on the particular golf ball construction and playing characteristics being targeted. Core center and/or layer hardness can range, for example, from 35 Shore C to about 95 Shore C, or 50 Shore C to about 90 Shore C, or 60 Shore C to about 85 Shore C, or 45 Shore C to about 75 Shore C, or 40 Shore C to about 85 Shore C. In other embodiments, core center and/or layer hardness can range, for example, from about 20 Shore D to about 70 Shore D, or from about 30 Shore D to about 60 Shore D, or from about 40 Shore D to about 50 Shore D, or 50 Shore D or less, or greater than 50 Shore D.

The compression of the core is generally overall in the range of about 40 to about 110, although embodiments are envisioned wherein the compression of the core is as low as 15. In other embodiments, the overall CoR of cores of the present invention at 125 ft/s is at least 0.750, or at least 0.775 or at least 0.780, or at least 0.785, or at least 0.790, or at least 0.795, or at least 0.800. Cores are also known to comprise a variety of other materials that are typically also used for intermediate and cover layers. Intermediate layers may likewise also comprise materials generally used in cores and covers as described herein for example.

An intermediate layer is sometimes thought of as including any layer(s) disposed between the inner core (or center) and the outer cover of a golf ball, and thus in some embodiments, the intermediate layer may include an outer core layer, a casing layer, or inner cover layer(s). In this regard, a golf ball of the invention may include one or more intermediate layers. An intermediate layer may be used, if desired, with a multilayer cover or a multilayer core, or with both a multilayer cover and a multilayer core.

In one non-limiting embodiment, an intermediate layer having a thickness of about 0.010 inches to about 0.06 inches, is disposed about a core having a diameter ranging from about 1.5 inches to about 1.59 inches. In this embodiment, the core may consist of a conventional core material such as a rubber composition. In some embodiments, the intermediate layer may be covered by a conventional castable thermoset or injection moldable thermoplastic material or of any other cover materials discussed herein or as is otherwise known in the art.

Intermediate layer(s) may be formed, at least in part, from one or more homopolymeric or copolymeric materials, such as ionomers, primarily or fully non-ionomeric thermoplastic materials, vinyl resins, polyolefins, polyurethanes, polyureas, polyamides, acrylic resins and blends thereof, olefinic thermoplastic rubbers, block copolymers of styrene and butadiene, isoprene or ethylene-butylene rubber, copoly (ether-amide), polyphenylene oxide resins or blends thereof, and thermoplastic polyesters.

The range of thicknesses for an intermediate layer of a golf ball is large because of the vast possibilities when using an intermediate layer, i.e., as an outer core layer, an inner cover layer, a wound layer, a moisture/vapor barrier layer. When used in a golf ball of the present invention, the intermediate layer, or inner cover layer, may have a thickness about 0.3 inches or less. In one embodiment, the thickness of the intermediate layer is from about 0.002 inches to about 0.1 inches, and preferably about 0.01 inches or greater. For example, when part of a three-piece ball or multi-layer ball according to the invention, the intermediate layer and/or inner cover layer may have a thickness ranging from about 0.010 inches to about 0.06 inches. In another embodiment, the intermediate layer thickness is about 0.05 inches or less, or about 0.01 inches to about 0.045 inches for example.

The cover typically has a thickness to provide sufficient strength, good performance characteristics, and durability. In one embodiment, the cover thickness may for example be from about 0.02 inches to about 0.12 inches, or about 0.1 inches or less. For example, the cover may be part of a two-piece golf ball and have a thickness ranging from about 0.03 inches to about 0.09 inches. In another embodiment, the cover thickness may be about 0.05 inches or less, or from about 0.02 inches to about 0.05 inches, or from about 0.02 inches and about 0.045 inches.

The cover may be a single-, dual-, or multi-layer cover and have an overall thickness for example within a range having a lower limit of 0.010 or 0.020 or 0.025 or 0.030 or 0.040 or 0.045 inches and an upper limit of 0.050 or 0.060 or 0.070 or 0.075 or 0.080 or 0.090 or 0.100 or 0.150 or 0.200 or 0.300 or 0.500 inches. In a particular embodiment, the cover may be a single layer having a thickness of from 0.010 or 0.020 or 0.025 inches to 0.035 or 0.040 or 0.050 inches. In another particular embodiment, the cover may consist of an inner cover layer having a thickness of from 0.010 or 0.020 or 0.025 inches to 0.035 or 0.050 inches and an outer cover layer having a thickness of from 0.010 or 0.020 or 0.025 inches to 0.035 or 0.040 inches.

In one embodiment, the cover may be a single layer having a surface hardness of 60 Shore D or greater, or 65 Shore D or greater. In a particular aspect of this embodiment, the cover is formed from a composition having a material hardness of 60 Shore D or greater, or 65 Shore D or greater.

In another particular embodiment, the cover may be a single layer having a thickness of from 0.010 or 0.020 inches to 0.035 or 0.050 inches and formed from an ionomeric composition having a material hardness of from 60 or 62 or 65 Shore D to 65 or 70 or 72 Shore D.

In yet another particular embodiment, the cover is a single layer having a thickness of from 0.010 or 0.025 inches to 0.035 or 0.040 inches and formed from a thermoplastic composition selected from ionomer-, polyurethane-, and polyurea-based compositions having a material hardness of 62 Shore D or less, or less than 62 Shore D, or 60 Shore D or less, or less than 60 Shore D, or 55 Shore D or less, or less than 55 Shore D.

In still another particular embodiment, the cover is a single layer having a thickness of from 0.010 or 0.025 inches to 0.035 or 0.040 inches and formed from a thermosetting polyurethane- or polyurea-based composition having a material hardness of 62 Shore D or less, or less than 62 Shore D, or 60 Shore D or less, or less than 60 Shore D, or 55 Shore D or less, or less than 55 Shore D.

In an alternative embodiment, the cover may comprise an inner cover layer formed from an ionomeric composition and an outer cover layer formed from a thermosetting polyurethane- or polyurea-based composition. The inner cover layer composition may have a material hardness of from 60 or 62 or 65 Shore D to 65 or 70 or 72 Shore D. The inner cover layer may have a thickness within a range having a lower limit of 0.010 or 0.020 or 0.030 inches and an upper limit of 0.035 or 0.040 or 0.050 inches. The outer cover layer composition may have a material hardness of 62 Shore D or less, or less than 62 Shore D, or 60 Shore D or less, or less than 60 Shore D, or 55 Shore D or less, or less than 55 Shore D. The outer cover layer may have a thickness within a range having a lower limit of 0.010 or 0.020 or 0.025 inches and an upper limit of 0.035 or 0.040 or 0.050 inches.

In another embodiment, the cover may comprise an inner cover layer formed from an ionomeric composition and an outer cover layer formed from a thermoplastic composition selected from ionomer-, polyurethane-, and polyurea-based compositions. The inner cover layer composition may have a material hardness of from 60 or 62 or 65 Shore D to 65 or 70 or 72 Shore D. The inner cover layer may have a thickness within a range having a lower limit of 0.010 or 0.020 or 0.030 inches and an upper limit of 0.035 or 0.040 or 0.050 inches. The outer cover layer composition may have a material hardness of 62 Shore D or less, or less than 62 Shore D, or 60 Shore D or less, or less than 60 Shore D, or 55 Shore D or less, or less than 55 Shore D. The outer cover layer may have a thickness within a range having a lower limit of 0.010 or 0.020 or 0.025 inches and an upper limit of 0.035 or 0.040 or 0.050 inches.

In yet another embodiment, the cover is a dual- or multi-layer cover including an inner or intermediate cover layer formed from an ionomeric composition and an outer cover layer formed from a polyurethane- or polyurea-based composition. The ionomeric layer may have a surface hardness of 70 Shore D or less, or 65 Shore D or less, or less than 65 Shore D, or a Shore D hardness of from 50 to 65, or a Shore D hardness of from 57 to 60, or a Shore D hardness of 58, and a thickness within a range having a lower limit of 0.010 or 0.020 or 0.030 inches and an upper limit of 0.045 or 0.080 or 0.120 inches. The outer cover layer may be formed from a castable or reaction injection moldable polyurethane, polyurea, or copolymer or hybrid of polyurethane/polyurea. Such cover material may be thermosetting, but may be thermoplastic in other embodiments. The outer cover layer composition may have a material hardness of 85 Shore C or less, or 45 Shore D or less, or 40 Shore D or less, or from 25 Shore D to 40 Shore D, or from 30 Shore D to 40 Shore D. The outer cover layer may have a surface hardness within a range having a lower limit of 20 or 30 or 35 or 40 Shore D and an upper limit of 52 or 58 or 60 or 65 or 70 or 72 or 75 Shore D. The outer cover layer may have a thickness within a range having a lower limit of 0.010 or 0.015 or 0.025 inches and an upper limit of 0.035 or 0.040 or 0.045 or 0.050 or 0.055 or 0.075 or 0.080 or 0.115 inches.

It is envisioned that golf balls of the invention may also incorporate conventional coating layer(s) for the purposes usually incorporated. For example, one or more coating layer may have a combined thickness of from about 0.1 μm to about 100 μm, or from about 2 μm to about 50 μm, or from about 2 μm to about 30 μm. Meanwhile, each coating layer may have a thickness of from about 0.1 μm to about 50 μm, or from about 0.1 μm to about 25 μm, or from about 0.1 μm to about 14 μm, or from about 2 μm to about 9 μm, for example.

Golf balls of the invention may also include cover layers made of polymers such as ethylene, propylene, butene-1 or hexane-1 based homopolymers and copolymers including functional monomers such as acrylic and methacrylic acid and fully or partially neutralized ionomer resins and their blends, methyl acrylate, methyl methacrylate homopolymers and copolymers, imidized, amino group containing polymers, polycarbonate, reinforced polyamides, polyphenylene oxide, high impact polystyrene, polyether ketone, polysulfone, poly(phenylene sulfide), acrylonitrile-butadiene, acrylic-styrene-acrylonitrile, poly(ethylene terephthalate), poly(butylene terephthalate), poly(ethylene vinyl alcohol), poly(tetrafluoroethylene) and their copolymers including functional comonomers and blends thereof.

In one particular embodiment, ionomer resins can be used as the cover material. These cross-linked polymers contain inter-chain ionic bonding as well as covalent bonding. The ionomer resins include, for example, a copolymer of ethylene and an acid group such as methacrylic or acrylic acid. Metal ions such as sodium, lithium, zinc, and magnesium are used to neutralize the acid groups in the polymer. Commercially available ionomer resins are known in the industry and include numerous resins sold under the trademarks, Surlyn® (DuPont) and Escor® and lotek® (Exxon). These ionomer resins are available in various grades and are identified based on the type of base resin, molecular weight, type of metal ion, amount of acid, degree of neutralization, additives, and other properties.

Non-limiting examples of suitable ionomers include partially neutralized ionomers, blends of two or more partially neutralized ionomers, highly neutralized ionomers, blends of two or more highly neutralized ionomers, and blends of one or more partially neutralized ionomers with one or more highly neutralized ionomers. Methods of preparing ionomers are well known, and are disclosed, for example, in U.S. Pat. No. 3,264,272, the entire disclosure of which is hereby incorporated herein by reference. The acid copolymer can be a direct copolymer wherein the polymer is polymerized by adding all monomers simultaneously, as disclosed, for example, in U.S. Pat. No. 4,351,931, the entire disclosure of which is hereby incorporated herein by reference. Alternatively, the acid copolymer can be a graft copolymer wherein a monomer is grafted onto an existing polymer, as disclosed, for example, in U.S. Patent Application Publication No. 2002/0013413, the entire disclosure of which is hereby incorporated herein by reference.

Examples of suitable partially neutralized acid polymers include, but are not limited to, Surlyn® ionomers, commercially available from E.I. du Pont de Nemours and Company; AClyn® ionomers, commercially available from Honeywell International Inc.; and lotek® ionomers, commercially available from Exxon Mobil Chemical Company. Some suitable examples of highly neutralized ionomers (HNP) are DuPont® HPF 1000 and DuPont® HPF 2000, ionomeric materials commercially available from E.I. du Pont de Nemours and Company. In some embodiments, very low modulus ionomer-("VLMI-") type ethylene-acid polymers are particularly suitable for forming the HNP, such as Surlyn® 6320, Surlyn® 8120, Surlyn® 8320, and Surlyn® 9320, commercially available from E.I. du Pont de Nemours and Company.

Any or each of core layers, intermediate/casing layers, and cover layers may be formed from ionomeric materials including blends of ionomers such as blends of HNP materials. The acid moieties of the HNP's, typically ethylene-based ionomers, are preferably neutralized greater than about 70%, more preferably greater than about 90%, and most preferably at least about 100%. The HNP's can be also be blended with a second polymer component, which, if containing an acid group, may also be neutralized. The second polymer component, which may be partially or fully neutralized, may comprise for example ionomeric copolymers and terpolymers, ionomer precursors, thermoplastics, polyamides, polycarbonates, polyesters, polyurethanes, polyureas, polyurethane/urea hybrids, thermoplastic elastomers, polybutadiene rubber, balata, metallocene-catalyzed polymers (grafted and non-grafted), single-site polymers, high-crystalline acid polymers, cationic ionomers, and the like. HNP's typically have a material hardness of between about 20 and about 80 Shore D, and a flexural modulus of between about 3,000 psi and about 200,000 psi.

Additional suitable materials for golf ball layers include conventional polyurethanes; conventional polyureas; conventional copolymers and hybrids of polyurethane and polyurea; polyethylene, including, for example, low density polyethylene, linear low density polyethylene, and high density polyethylene; polypropylene; rubber-toughened olefin polymers; acid copolymers, e.g., (meth)acrylic acid, which do not become part of an ionomeric copolymer; plastomers; flexomers; styrene/butadiene/styrene block copolymers; styrene/ethylene-butylene/styrene block copolymers; dynamically vulcanized elastomers; ethylene vinyl acetates; ethylene methyl acrylates; polyvinyl chloride resins; polyamides, amide-ester elastomers, and graft copolymers of ionomer and polyamide, including, for example, Pebax® thermoplastic polyether block amides, commercially available from Arkema Inc; crosslinked trans-polyisoprene and blends thereof; polyester-based thermoplastic elastomers, such as Hytrel®, commercially available from E.I. du Pont de Nemours and Company; polyurethane-based thermoplastic elastomers, such as Elastollan®, commercially available from BASF; synthetic or natural vulcanized rubber; and combinations thereof.

Examples of yet other materials which may be suitable for incorporating and coordinating in order to target and achieve desired playing characteristics or feel include plasticized thermoplastics, polyalkenamer compositions, polyester-based thermoplastic elastomers containing plasticizers, transparent or plasticized polyamides, thiolene compositions, polyamide and anhydride-modified polyolefins, organic acid-modified polymers, and the like.

It is envisioned that layers other than the cast layer of inventive mixture may be incorporated in a golf ball of the invention via any of casting, compression molding, injection molding, or thermoforming. Thermoset materials are typically formed into golf ball layers by conventional reaction injection molding and compression molding techniques as well as casting, whereas thermoplastic materials are generally formed into golf ball layers by conventional compression or injection molding techniques.

A compression molding mold typically has a mold cavity formed in a pair of hemispherical molds, into which the subassembly may be placed. A combination of heat and pressure is then applied, and results in the half shells being fused to the outer surface of the subassembly as a unitary one-piece layer about the subassembly.

When injection molding is used to form a golf ball layer, the layer composition is typically in a pelletized or granulated form that can be easily fed into the throat of an injection molding machine wherein it is melted and conveyed via a screw in a heated barrel at temperatures of from about 150° F. to about 600° F., preferably from about 200° F. to about 500° F. The molten composition is ultimately injected into a closed mold cavity, which may be cooled, at ambient or at an elevated temperature, but typically the mold is cooled to a temperature of from about 50° F. to about 70° F. After residing in the closed mold for a time of from 1 second to 300 seconds, preferably from 20 seconds to 120 seconds, the core and/or core plus one or more additional core or other layers is removed from the mold and either allowed to cool at ambient or reduced temperatures or is placed in a cooling fluid such as water, ice water, dry ice in a solvent, or the like.

In the present invention, "compression" is measured according to a known procedure, using an Atti compression test device, wherein a piston is used to compress a ball against a spring. The travel of the piston is fixed and the deflection of the spring is measured. The measurement of the deflection of the spring does not begin with its contact with the ball; rather, there is an offset of approximately the first 1.25 mm (0.05 inches) of the spring's deflection. Cores having a very low stiffness will not cause the spring to deflect by more than 1.25 mm and therefore have a zero compression measurement. The Atti compression tester is designed to measure objects having a diameter of 1.680 inches; thus, smaller objects, such as golf ball cores, must be shimmed to a total height of 1.680 inches to obtain an accurate reading. Conversion from Atti compression to Riehle (cores), Riehle (balls), 100 kg deflection, 130-10 kg deflection or effective modulus can be carried out according to the formulas given in J. Dalton.

In a golf ball if the invention, Coefficient of Restitution or CoR is determined according to a known procedure, wherein a golf ball or golf ball subassembly (for example, a golf ball core) is fired from an air cannon at two given velocities and a velocity of 125 ft/s is used for the calculations. Ballistic light screens are located between the air cannon and steel plate at a fixed distance to measure ball velocity. As the ball travels toward the steel plate, it activates each light screen and the ball's time period at each light screen is measured. This provides an incoming transit time period which is inversely proportional to the ball's incoming velocity. The ball makes impact with the steel plate and rebounds so it passes again through the light screens. As the rebounding ball activates each light screen, the ball's time period at each screen is measured. This provides an outgoing transit time period which is inversely proportional to the ball's outgoing velocity. CoR is then calculated as the ratio of the outgoing transit time period to the incoming transit time period, $CoR=V_{out}/V_{in}=T_{in}/T_{out}$. The CoR value can be targeted, for example, by varying the core peroxide and antioxidant types and amounts as well as the cure temperature and duration.

The surface hardness of a golf ball layer is obtained from the average of a number of measurements taken from opposing hemispheres, taking care to avoid making measurements on the parting line of the core or on surface defects such as holes or protrusions. Hardness measurements are made pursuant to ASTM D-2240 "Indentation Hardness of Rubber and Plastic by Means of a Durometer." Because of the curved surface of the golf ball layer, care must be taken to ensure that the golf ball or golf ball subassembly is centered under the durometer indentor before a surface hardness reading is obtained. A calibrated digital durometer, capable of reading to 0.1 hardness units, is used for all hardness measurements. The digital durometer must be attached to and its foot made parallel to the base of an automatic stand. The weight on the durometer and attack rate conforms to ASTM D-2240. It should be understood that there is a fundamental difference between "material hardness" and "hardness as measured directly on a golf ball." For purposes of the present invention, material hardness is measured according to ASTM D2240 and generally involves measuring the hardness of a flat "slab" or "button" formed of the material. Surface hardness as measured directly on a golf ball (or other spherical surface) typically results in a different hardness value. The difference in "surface hardness" and "material hardness" values is due to several factors including, but not limited to, ball construction (that is, core type, number of cores and/or cover layers, and the like); ball (or sphere) diameter; and the material composition of adjacent layers. It also should be understood that the two measurement techniques are not linearly related and, therefore, one hardness value cannot easily be correlated to the other.

Golf balls of the present invention preferably have a moment of inertia ("MOI") of 70-95 $g\cdot cm^2$, preferably 75-93 $g\cdot cm^2$, and more preferably 76-90 $g\cdot cm^2$. For low MOI embodiments, the golf ball preferably has an MOI of 85 $g\cdot cm^2$ or less, or 83 $g\cdot cm^2$ or less. For high MOI embodiment, the golf ball preferably has an MOI of 86 $g\cdot cm^2$ or greater, or 87 $g\cdot cm^2$ or greater. MOI is measured on a model MOI-005-104 Moment of Inertia Instrument manufactured by Inertia Dynamics of Collinsville, Conn. The instrument is connected to a PC for communication via a COMM port and is driven by MOI Instrument Software version #1.2.

Thermoset and thermoplastic layers herein may be treated in such a manner as to create a positive or negative hardness gradient. In golf ball layers of the present invention wherein a thermosetting rubber is used, gradient-producing processes and/or gradient-producing rubber formulation may be employed. Gradient-producing processes and formulations are disclosed more fully, for example, in U.S. patent application Ser. No. 12/048,665, filed on Mar. 14, 2008; Ser. No. 11/829,461, filed on Jul. 27, 2007; Ser. No. 11/772,903, filed Jul. 3, 2007; Ser. No. 11/832,163, filed Aug. 1, 2007; Ser. No. 11/832,197, filed on Aug. 1, 2007; the entire disclosure of each of these references is hereby incorporated herein by reference.

It is understood that the golf balls of the invention as described and illustrated herein represent only some of the many embodiments of the invention. It is appreciated by those skilled in the art that various changes and additions can be made to such golf balls without departing from the spirit and scope of this invention. It is intended that all such embodiments be covered by the appended claims.

A golf ball of the invention may further incorporate indicia, which as used herein, is considered to mean any symbol, letter, group of letters, design, or the like, that can be added to the dimpled surface of a golf ball.

Golf balls of the present invention will typically have dimple coverage of 60% or greater, preferably 65% or greater, and more preferably 75% or greater. It will be appreciated that any known dimple pattern may be used with any number of dimples having any shape or size. For example, the number of dimples may be 252 to 456, or 330 to 392 and may comprise any width, depth, and edge angle. The parting line configuration of said pattern may be either a straight line or a staggered wave parting line (SWPL), for example.

In any of these embodiments the single-layer core may be replaced with a two or more layer core wherein at least one core layer has a hardness gradient.

Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

Although the golf ball of the invention has been described herein with reference to particular means and materials, it is to be understood that the invention is not limited to the particulars disclosed and extends to all equivalents within the scope of the claims.

What is claimed is:

1. A golf ball comprising a subassembly and at least one cast layer formed from a thermoset polymer mixture having a centering time $Ct_1$ and comprising: (i) at least one of a polyurethane composition, a polyurea composition, or a polyurethane/polyurea hybrid composition; and (ii) a treated fumed silica compound in an amount such that centering time $Ct_1$ is independent of the thermoset polymer mixture's degree of cure and lower than a centering time $Ct_2$ of the at least one of a polyurethane composition, a polyurea composition, or a polyurethane/polyurea hybrid composition.

2. The golf ball of claim 1, wherein the treated fumed silica compound is surface treated with at least one of polydimethylsiloxane, hexamethyldisilazane, and dimethyldichlorosilane.

3. The golf ball of claim 1, wherein centering time $Ct_2$ is dependent on a gel window $G_w$ of the thermoset polymer composition.

4. The golf ball of claim 1, wherein a delta time $\Delta t_1$ between a dispensing time $D_{t1}$ of the thermoset polymer mixture and centering time $Ct_1$ is less than a delta time $\Delta t_2$ between $Ct_1$ and centering time $Ct_2$.

5. The golf ball of claim 4, wherein centering time $Ct_1$ and dispensing time $D_{t1}$ differ by less than 10 seconds.

6. The golf ball of claim 5, wherein centering time $Ct_1$ and dispensing time $D_{t1}$ differ by 5 seconds or less.

7. The golf ball of claim 1, wherein a prepolymer and the treated fumed silica are included in the thermoset polymer mixture in a ratio of from about 4:1 to about 18:1.

8. The golf ball of claim 7, wherein a prepolymer and the treated fumed silica are included in the thermoset polymer mixture in a ratio of from about 10:1 to about 12:1.

9. The golf ball of claim 1, wherein a curative and the treated fumed silica are included in the thermoset polymer mixture in a ratio of from about 0.5:1 to about 6:1.

10. The golf ball of claim 9, wherein a curative and the treated fumed silica are included in the thermoset polymer mixture in a ratio of from about 1.5:1 to about 2.5:1.

11. The golf ball of claim 1, wherein the cast layer has a thickness of 0.020 inches or greater.

12. The golf ball of claim 1, wherein the cast layer has a thickness of from 0.015 inches to 0.050 inches.

13. The golf ball of claim 11, wherein the cast layer has a thickness of 0.025 or greater.

14. The golf ball of claim 1, wherein the thermoset polymer mixture is a foam composition and centering time $Ct_1$ of the thermoset polymer mixture is less than its rise time $Rt_1$.

15. The golf ball of claim 1, wherein a delta time $\Delta t_1$ between a dispensing time $D_{t1}$ of the thermoset polymer mixture and centering time $Ct_1$ is less than a delta time $\Delta t_3$ between $Ct_1$ and rise time $Rt_1$.

16. The golf ball of claim 1, wherein deionized water and the treated fumed silica are included in the thermoset polymer mixture in a ratio of from about 3:1 to about 13:1.

* * * * *